US012089712B2

(12) United States Patent
Ahrens

(10) Patent No.: US 12,089,712 B2
(45) Date of Patent: Sep. 17, 2024

(54) HEAT ENHANCED HAIR-SETTING TOOL

(71) Applicant: HAIR4GOOD, Wilton, CT (US)

(72) Inventor: Mary Ahrens, Wilton, CT (US)

(73) Assignee: HAIR4GOOD, Wilton, CT (US)

( * ) Notice: Subject to any disclaimer, the term of this patent is extended or adjusted under 35 U.S.C. 154(b) by 639 days.

(21) Appl. No.: 17/273,561

(22) PCT Filed: Sep. 4, 2019

(86) PCT No.: PCT/US2019/049592
§ 371 (c)(1),
(2) Date: Mar. 4, 2021

(87) PCT Pub. No.: WO2020/051245
PCT Pub. Date: Mar. 12, 2020

(65) Prior Publication Data

US 2021/0251360 A1 Aug. 19, 2021

Related U.S. Application Data

(60) Provisional application No. 62/726,787, filed on Sep. 4, 2018.

(51) Int. Cl.

| | |
|---|---|
| ***A45D 1/04*** | (2006.01) |
| ***A45D 2/36*** | (2006.01) |
| ***A45D 20/50*** | (2006.01) |
| *A45D 1/00* | (2006.01) |

(52) U.S. Cl.
CPC ..... *A45D 1/04* (2013.01); *A45D 2/362* (2013.01); *A45D 20/50* (2013.01); *A45D 2001/008* (2013.01)

(58) Field of Classification Search
CPC ..... A45D 1/04; A45D 2/362; A45D 20/50; A45D 2001/008; A45D 20/12; A45D 20/10; H02K 29/14; H02K 5/225; H02K 11/0073; H02K 11/33
USPC ..... 219/200, 222, 380, 383, 384
See application file for complete search history.

(56) References Cited

U.S. PATENT DOCUMENTS

| | | | | |
|---|---|---|---|---|
| 2005/0016559 A1* | 1/2005 | Saida | ..... | A46B 15/0002 132/271 |
| 2013/0192625 A1* | 8/2013 | Migliori | ..... | A45D 1/28 132/211 |

FOREIGN PATENT DOCUMENTS

| | | | | |
|---|---|---|---|---|
| CN | 207783577 U | | 8/2018 | |
| CN | 207784577 U | * | 8/2018 | ..... A45D 2/36 |
| JP | H02168903 A | * | 6/1990 | ..... A45D 2/00 |
| JP | 2010220858 A | | 10/2010 | |

OTHER PUBLICATIONS

International Search Report from PCT/US2019/049592.

* cited by examiner

*Primary Examiner* — Phuong T Nguyen
(74) *Attorney, Agent, or Firm* — Potomac Law Group, PLLC; Jamaica Potts Szeliga

(57) ABSTRACT

A hair-setting tool for setting hair styles is specifically configured to exhibit an improved hair-setting effect with the aid of heat. The heat-enhanced hair-setting tool of the present invention includes one or more heating components in or on the main body of the hair-setting tool. The heat required for setting hair may be provided by the heating components and/or by heating or re-heating the hair-setting tool to activate the heating components.

32 Claims, 19 Drawing Sheets

HEAT ENHANCED HAIR-SETTING TOOL

RELATED APPLICATION

The present application is a National Stage application of International Application No. PCT/US2019/049592, filed Sep. 4, 2019, which claims priority from U.S. provisional patent application Ser. No. 62/726,787 filed Sep. 4, 2018, both of which are incorporated herein by reference in their entireties.

FIELD OF THE INVENTION

The present invention relates to a hair-setting tool such as a hair brush or comb, one or more hair rollers, hair curling tools, a hot-air styling brush, a hair straightener or crimper, a curling iron, a spiral iron, a hair waver or crimper, and the like, and more particularly to a heat-enhanced hair-setting tool, which provides heat while setting hair so as to improve the hair-setting performance and efficiency of the hair-setting tool.

BACKGROUND OF THE INVENTION

Many hairstyling appliances utilize heat to encourage hair to assume a new shape or desired style. For example, styling techniques may include drying, straightening, curling, and crimping. It generally takes a long time to set hair with a hair brush, hair comb, hair roller, hair dryer and/or hair straightener in order to have a satisfactory hair style. Most hair brushes, combs and rollers do not have heating functions or components, and thus the user must work with a direct heat source such as a blow dryer. Heat may be applied to hair for styling by blowing hot air, for example, by using hair dryers or hot-air styling brushes, which require the use of electricity. Because hot air from a blow dryer or a hot-air styling brush reaches not only the hair but also the scalp, which is more heat-sensitive than hair, the temperature needs be carefully controlled to protect the scalp. However moderating the temperature to avoid overheating skin limits the effectiveness of hair-setting.

Some hair-setting tools use electricity to achieve the heating purpose. In this case, heat is directly applied to the hair, for example by using styling irons or hot rollers, or other hair-setting tools. However, these traditional tools may be noisy, limit movement of the user due to wires, use electricity, and create hazards given that they are typically used in bathrooms near sources of water.

There thus is a need to develop a heat-enhancing delivery system for styling hair, such as heat-enhanced hair-setting styling tools capable of efficient heat conductivity compared to conventional styling tools. There is also a need for such tools that minimize damage to the hair, improve the setting performance of the tool, are convenient to use, require less electricity, may cause less damage to the hair than conventional items currently on the market, and/or may reduce the weight of such items.

SUMMARY

The present invention provides heat-enhanced hair-setting tools capable of more efficient heat transfer than conventional hair-settling tools with little or minimized damage to hair that may improve the setting performance of the hair-setting tool while being convenient to used. The hair-setting tools of the present invention are designed to include one or more heating components that allow for heat and steam to be retained, generated, and/or reflected after heating for an extended period of time.

According to one embodiment of the present invention, the hair-setting tool may include a body and a heating component disposed substantially within, or entirely within, said body, wherein said heating component conveys heat and/or steam indirectly or directly to the hair of the user.

According to other embodiments of the present invention, the hair-setting tool may include a body and a heating component disposed at least in part on top of the body of the hair-setting tool, wherein said heating component conveys heat and/or steam indirectly or directly to the hair of the user.

In certain embodiments of the present invention, the heating component may comprise one or more sheets of metal foil, one or more lengths of heat-conductive wire, and/or one or more lengths of heat-conductive tape.

In certain embodiments of the invention, the body of the hair-setting tool may have holes or vents through which the heat and/or steam from the heating component may dissipate from the body of the hair-setting tool.

According to certain embodiments of the present invention, the hair-setting tool may also be a brush and have a supporting base and bristles. In one such embodiment, the hair-setting tool may be a cushion brush hair-setting tool, wherein said bristles protrude from a cushion member disposed on the supporting base of the body. In other embodiments, the hair-setting tool may be a detangling brush hair-setting tool, wherein the bristles protrude from the supporting base of the body of the hair-setting tool. In further embodiments, the hair-setting tool may be a round brush hair-setting tool, a vent brush hair-setting tool, and/or a hot air brush hair-setting tool. In certain embodiments wherein the hair-setting tool is a brush, the heating component may be disposed on the surface opposite or adjacent to the bristles of the hair-setting tool rather than on the same surface as the bristles.

In other embodiments of the invention, the hair-setting tool may be a smooth barrel hair-setting tool, a covered barrel hair-setting tool, one or more hair roller hair-setting tools, a hair straightener hair-setting tool, and/or a curling iron hair-setting tool.

In another embodiment of the present invention, the hair-setting tool further includes a protective layer disposed in whole or in part on one or more surfaces of heating component. This protective layer may protect the other portions of the hair-setting tool or the user's hair from the heating component. In certain embodiments, the protective layer may contain one or more holes from which heat and/or steam from the heating component may dissipate. In certain embodiments, the protective layer may comprise a carpeting structure, wherein said carpeting structure comprises a plurality of mini-posts, hook posts, loop posts, curved posts, and/or Velcro or Velcro-like loops.

According to further embodiments of the present invention, the hair-setting tool may include a body, wherein all or a portion of the body is covered with a paint, and a heating component, wherein said heating component is the paint covering all or a portion of the body and wherein the paint generates heat or retains heat that assists in setting hair. One non-limiting example of such an embodiment would be a hair-setting tool wherein the paint comprises graphene or other carbon-based materials.

BRIEF DESCRIPTION OF THE DRAWINGS

The above contents of the present invention will become more readily apparent to those ordinarily skilled in the art after reviewing the following detailed description and accompanying drawings, in which.

DETAILED DESCRIPTION

Figure 1A:
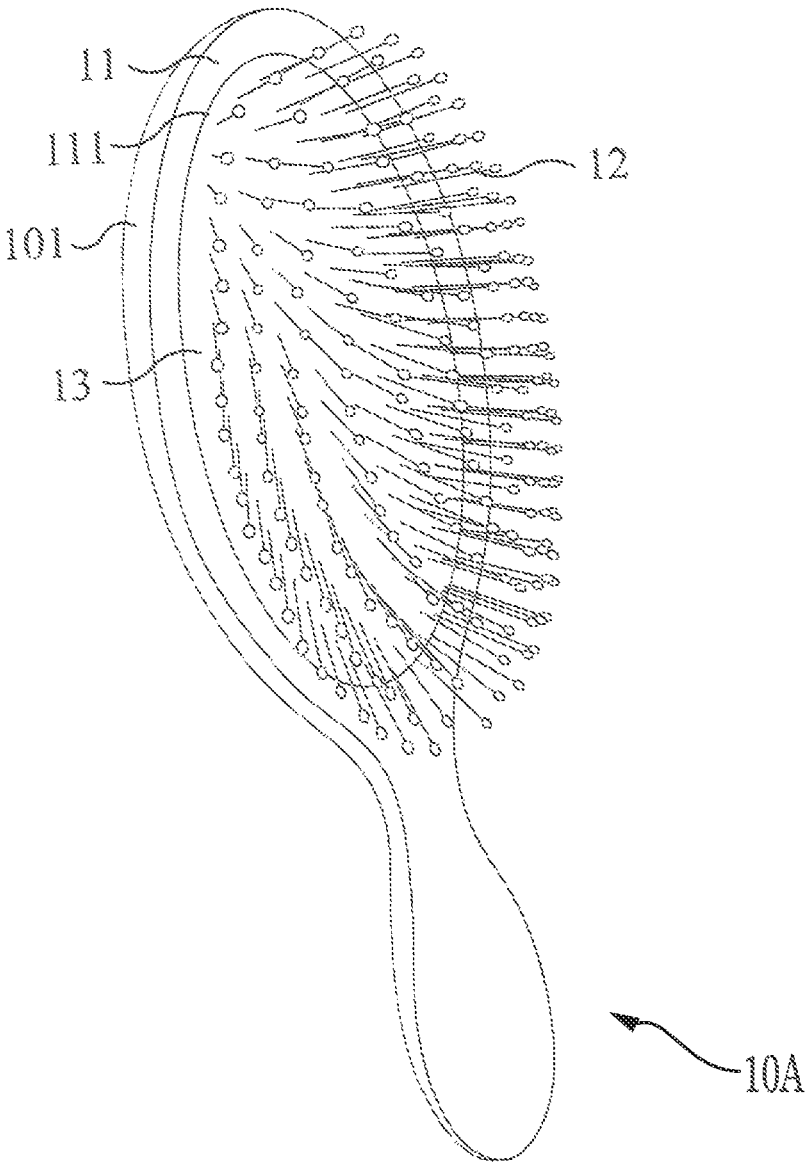
FIG. 1A is a schematic diagram of a cushion brush hair-setting tool according to an embodiment of the present invention.

Reference will now be made in detail to the embodiments of the present disclosure, examples of which are illustrated in FIGS. 1-15. The reference numerals used in the detailed description of the embodiment below correspond to the reference numerals used in the accompanying drawings. While these embodiments are described in sufficient detail to enable those skilled in the art to practice the disclosure, it should be understood that other embodiments may be realized, and that logical and physical changes may be made without departing from the spirit and scope of the invention. Thus, the detailed description herein is presented for purposes of illustration only rather than as limitations. Moreover, references to a singular embodiment may include plural embodiments, and references to more than one component may include a singular embodiment.

The present invention provides heat-enhanced hair-setting tools capable of more efficient heat transfer than conventional hair-settling tools with little or minimized damage to hair that may improve the setting performance of the hair-setting tool while being convenient to used. The hair-setting tools of the present invention are designed to include one or more heating components that allow for heat and steam to be generated, retained, and/or reflected after heating for an extended period of time.

Figure 1B:
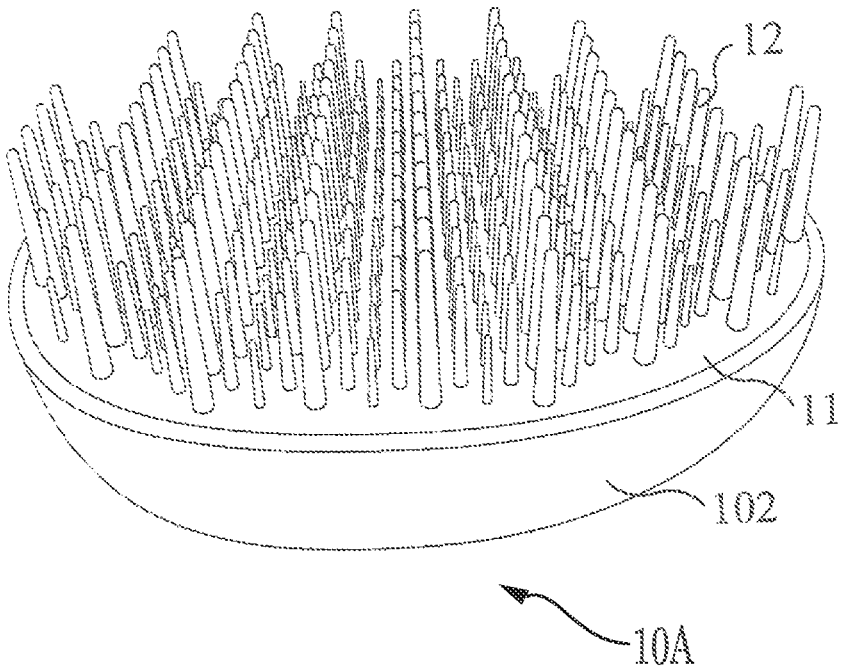
FIG. 1B is a schematic diagram of a detangling brush hair-setting tool according to an embodiment of the present invention.
Figure 1C:
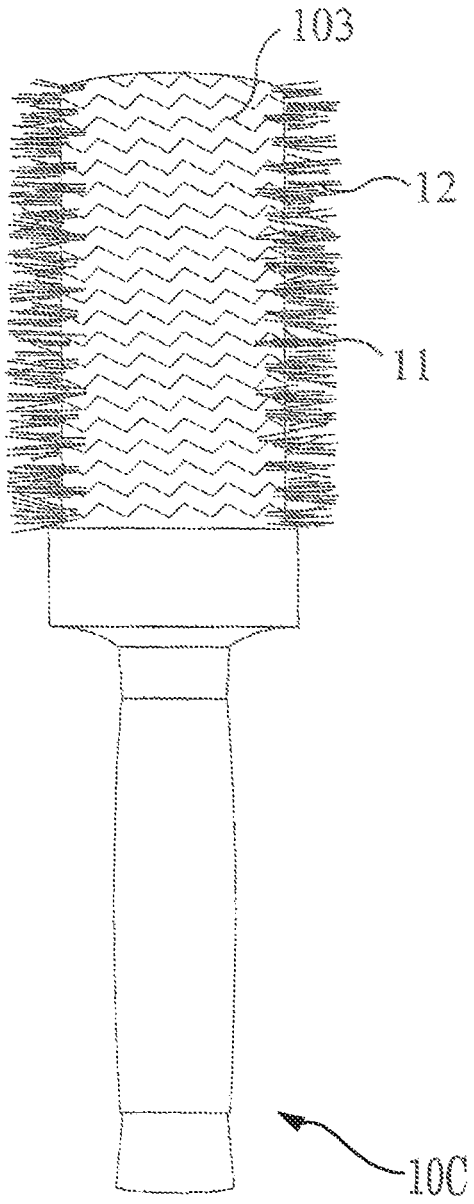
FIG. 1C is a schematic diagram of a round brush hair-setting tool according to an embodiment of the present invention.
Figure 1D:
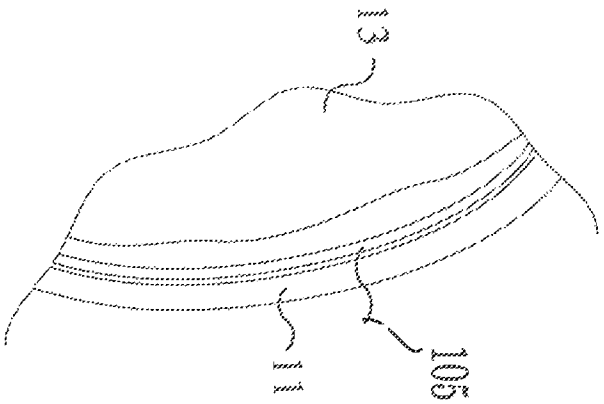
FIG. 1D is a schematic diagram illustrating a cross-sectional view of the cushion brush hair-setting tool shown in FIG. 1A.

A variety of combs and brushes for smoothing hair are commercially available for use by consumers. A comb and a brush are different in shape and manufactured in different ways. However, both combs and brushes have a supporting base and a plurality of projections, e.g. teeth (combs) or bristles (brushes), where the projections protrude from the supporting base. In general, the teeth of a comb are integrally formed with the supporting base with the same material. In comparison, the bristles of a brush may be integrally formed with the supporting base, secured onto the supporting base, or removably mounted onto the supporting base. Additionally, special comb or brush designs have also been developed and may be used to enhance hair-smoothing effects or for additional functions. Taking brushes as examples, a cushion brush hair-setting tool 10A according to an embodiment of the present invention is illustrated in FIG. 1A, a detangling brush hair-setting tool 10B according to an embodiment of the present invention is illustrated in FIG. 1B, and a round brush hair-setting tool 10C according to an embodiment of the present invention is illustrated in FIG. 1C, While, a cushion brush, a detangling brush, and a round brush variation of the hair-setting tool are illustrated, the present invention is not limited to such embodiments, which would also include comb hair-setting tools.

Each of the cushion brush, detangling brush, and the round brush hair-setting tools has a supporting base 11 and a plurality of bristles 12 protruding from the supporting base 11. The bristles 12 may be integrally formed with the supporting base 11 or attached onto the supporting base 11. As just one example, as shown in FIG. 1A, a cushion brush hair-setting tool generally includes a cushion member 13, through which the bristles 12 penetrate, and the bristles are lodged in holes of the cushion member 13. Alternatively, the bristles 12 may also be attached onto the surface of the cushion member 13. The cushion member 13 engages with the supporting base 11 at a surface 111 of the supporting base 11. The cushion member 13 may be coupled to the supporting base 11, for example, by snapping, gluing, nailing, crimping, or any other coupling method.

According to embodiments of the present invention, a specially designed heating component, which will be described in detail later, is provided to hair-setting tools to enhance hair-setting performance. The hair brushes equipped with said heating component may be used with or without the aid of a blow dryer.

In an embodiment of the hair-setting tools of the present invention, the heating component is disposed entirely inside the body of the hair-setting tool. For example, the heating component (not shown) may be accommodated in a space 101 within a hollow supporting base 11 of the cushion brush hair-setting tool 10A shown in FIG. 1A. As an alternative, and as illustrated and described in more detail in the enlarged view of the hair-setting tool of FIG. 1D, the heating component 105 may be accommodated in a space on top of the supporting base 11 and underneath the cushion member 13 of a cushion brush hair-setting tool 10A According to another embodiment of the hair-setting tool of the present invention, and as shown in FIG. 1B, the heating component (not shown) may be accommodated in a space 102 within the hollow supporting base 11 of the detangling brush hair-setting tool 10B. In a further embodiment, the heating component (not shown) may be accommodated in a space 103 within the round brush hair-setting tool 10C, as shown in FIG. 1C, or even within the core of the round brush hair-setting tool 10C (not shown).

Figure 2A:
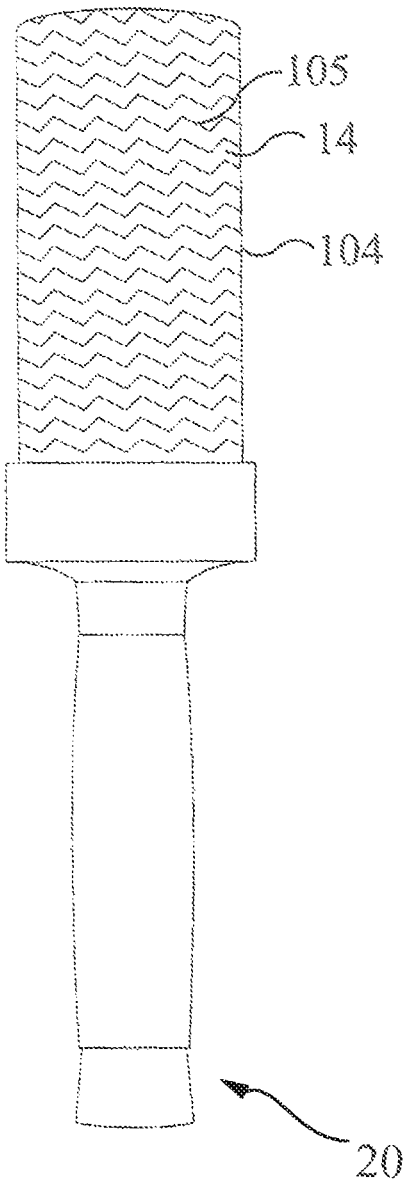
FIG. 2A is a schematic diagram of a smooth barrel hair-setting tool according to an embodiment of the present invention.

In another embodiment, the heating component may be disposed in whole or in part on an exterior surface of the hair-setting tool. FIG. 2A illustrates an embodiment of the invention where the hair-setting tool 20 is a smooth barrel hair-setting tool. When in use, hair is wound around a barrel 14 of the smooth barrel hair-setting tool 20 to perform a hair-curling effect. As one embodiment, heating component 105 may be positioned on the outer surface 104 of the barrel 14, covering the barrel in whole or in part.

Figure 2B:
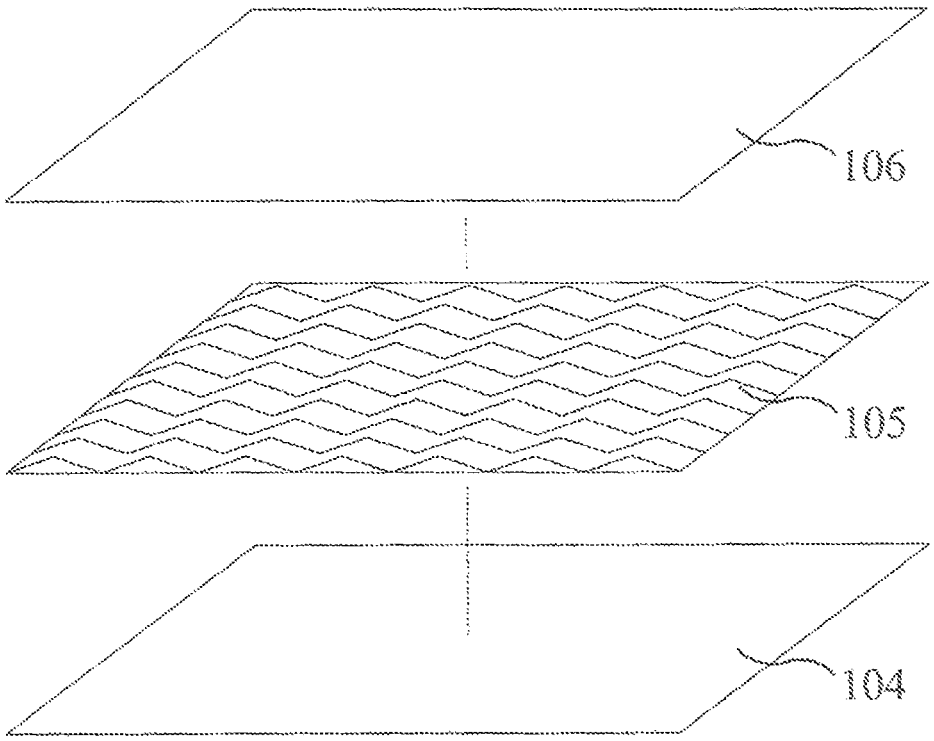
FIG. 2B is a schematic diagram illustrating a dissembled partial structure of the hair-setting tool shown in FIG. 2A.

In certain embodiments, a protective layer may be provided to protect the user's hair or the other components of the body of the hair-setting tool from the heating components. For example, as shown in FIG. 2B, a protective layer 106 may additionally be provided over the heating component 105 to isolate the heating component 105 from direct contact with hair wrapped around the smooth barrel hair-setting tool 20 to avoid overheating the hair.

In certain embodiments, the protective layer 106 may be made of a material which is heat-resistant to avoid damage by heat from the heating component 105. In other embodiments, the protective layer 106 should be made of a material with a thickness and/or configuration that allows heat to transfer from the heating component 105 to hair through at least one of conduction, convection and/or radiation. According to one embodiment, the protective layer 106 may be porous so that heat can be dissipated through the tiny holes (not shown) to reach the hair of the user.

Figure 3A:
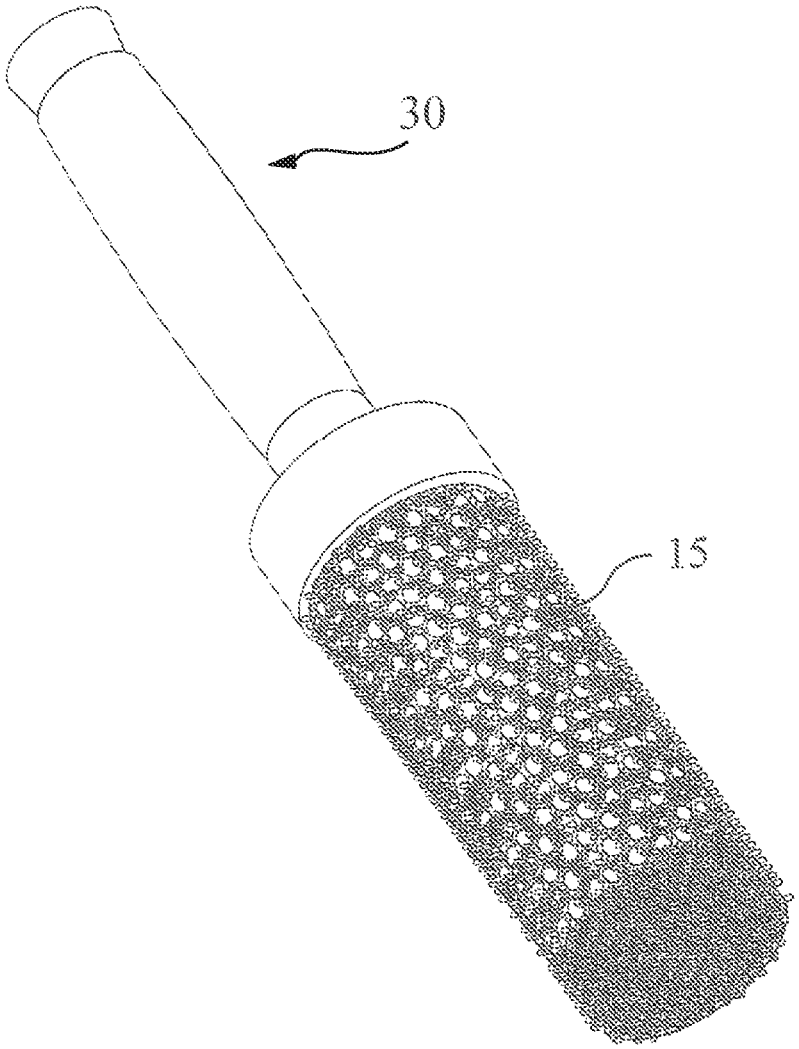
FIG. 3A is a schematic diagram of a covered barrel hair-setting tool according to an embodiment of the present invention.
Figure 3B:
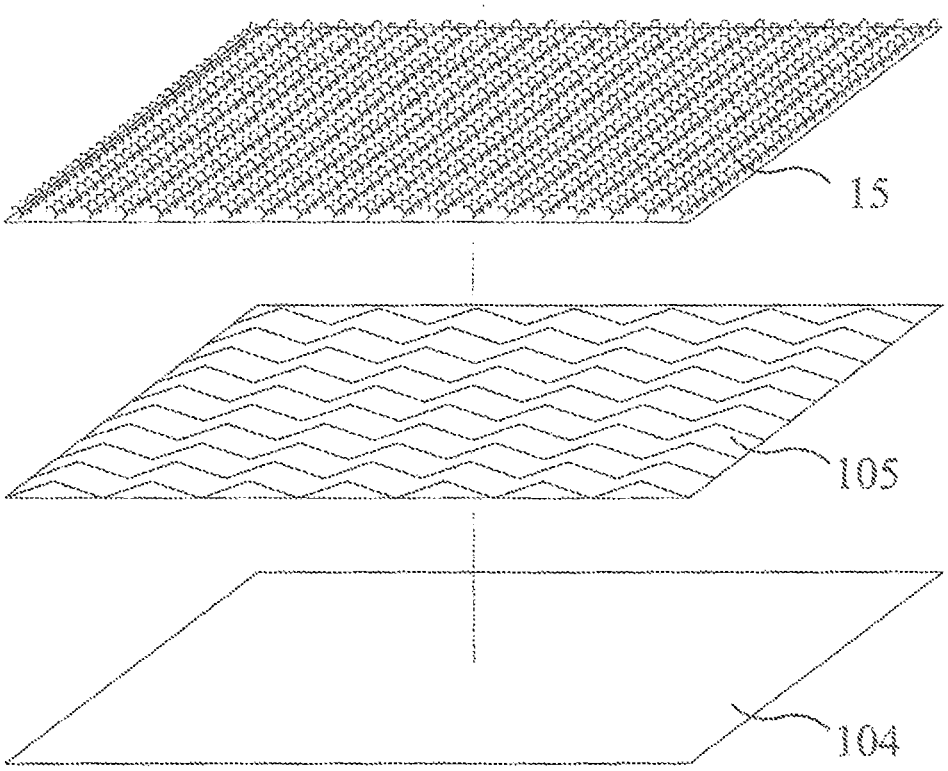
FIG. 3B is a schematic diagram illustrating a dissembled partial structure of the hair-setting tool shown in FIG. 3A.

Another embodiment of the hair-setting tool of the present invention is the covered barrel hair-setting tool 30 illustrated in FIG. 3A. The covered barrel hair-setting tool 30 is similar to the smooth barrel hair-setting tool 20 but contains a carpeting structure 15 that overlays, directly or indirectly, the heating component 105. The positions of the layers of material for one embodiment of the covered barrel hair-setting tool 30 is shown in FIG. 3B. As indicated in FIG. 3B, the heating component 105 covers in whole or in part the outer surface 104 of the barrel of the hair-setting tool 30 and the carpeting structure 15 covers in whole or in part the heating component.

In some embodiments, the carpeting structure 15 of the hair-setting tool 30 may include a plurality of mini-posts, hook posts, loop posts, curved posts, or Velcro or Velcro-like loops, which may be used, inter alia, for smoothing hair. In certain embodiments, the carpeting structure 15 may also be enhanced or adapted to moderate the heat from the heating component 105 and protect the hair of the user from direct contact with the heating component. In such embodiments, the carpeting structure 15 functions substantially similar to the protective layer 106 describe above. In an alternative embodiment not shown, a protective layer may be placed between the heating component and the carpeting structure.

Similarly, the cushion member 13 included in the cushion brush as shown in FIG. 1A, may be enhanced or adapted to include a protective layer when the heating component is disposed inside the brush body. In an alternative embodiment, a protective layer may be placed between the cushion member and the heating component of the brush body.

Figure 4:
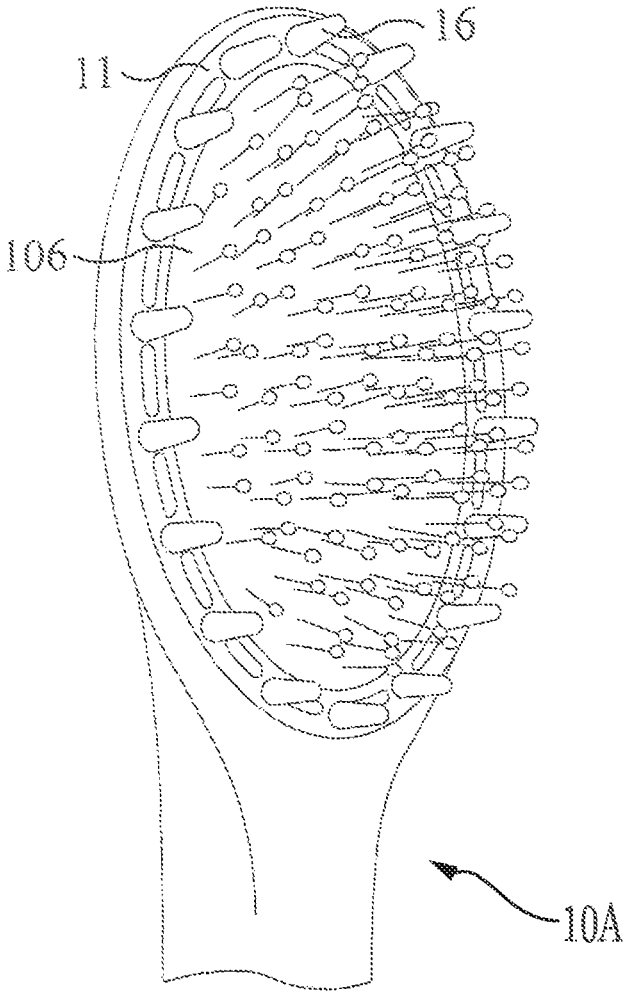
FIG. 4 is a schematic diagram illustrating the mounting of a heating component onto a cushion brush hair-setting tool according to an embodiment of the present invention.

FIG. 4 illustrates an example of a cushion brush hair-setting tool 10A where the protective layer 106 is secured onto the supporting base 11 with a snapping member 16, thereby retaining the heating component within the space between the protective layer 106 and the supporting base 11, and protecting the hair from the heating component beyond the edges of the cushion member.

Figure 5:
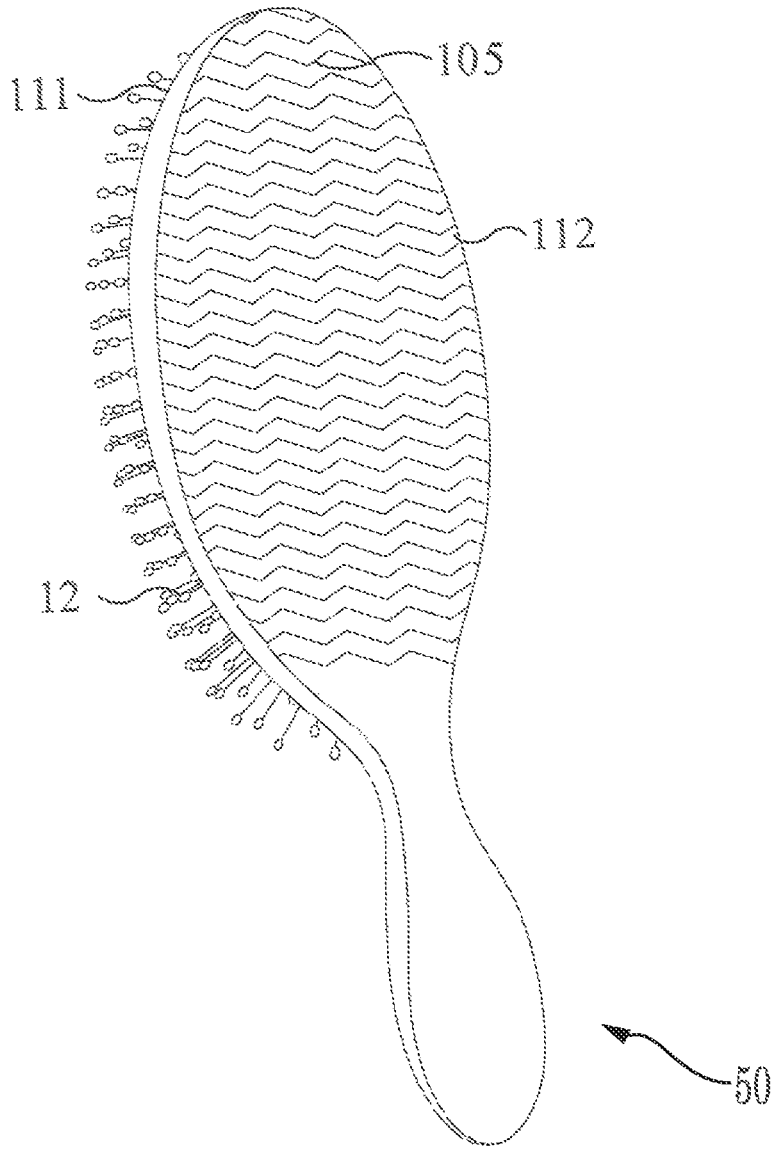
FIG. 5 is a schematic diagram illustrating an alternative placement of the heating component of a brush hair-setting tool according to an embodiment of the present invention.

In a further embodiment of the present invention, as illustrated in FIG. 5, a hair-setting tool 50, is provided that is a brush, non-limiting examples of which are shown in FIG. 1A or FIG. 1B. In certain embodiments, the hair-setting tool 50 may include the heating component 105, and optionally a protective layer 106 (not shown), on the back surface 112 of the hair-setting tool 50 that is opposite to the surface 111 where bristles 12 are disposed. In alternative embodiments, not shown, the heating component may be located adjacent to the surface 111 where bristles 12 are disposed. The hair-setting tool 50 may be used for multiple functions, including but not limited to at least hair-smoothing and hair-setting.

Figure 6:
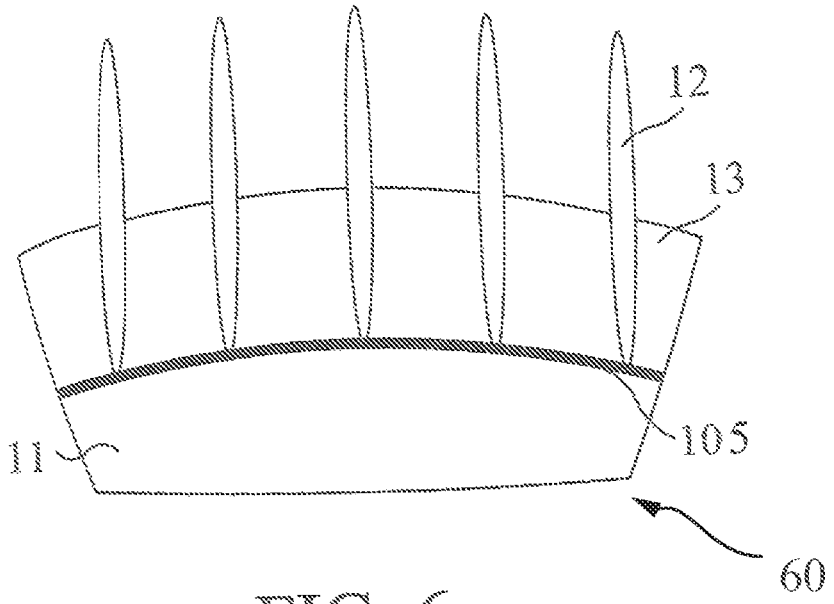
FIG. 6 is a schematic diagram illustrating the placement of the heating component into a vent brush hair-setting tool according to an embodiment of the present invention.

In FIG. 6, a cross-sectional view of a vent brush hair-setting tool 60 is schematically illustrated according to another embodiment of the present invention. In this embodiment, the heating component 105 is integrally formed with and, in certain embodiments, may be adapted to serve as a base for the bristles 12. As shown in FIG. 6, the bristles 12 of the vent brush hair-setting tool 60 may penetrate through the cushion member 13 to the heating component 105, which may in turn be in contact with an inner surface of the cushion member 13. In an alternative embodiment not shown, the cushion member 13 may be protected from the heating component 105 by a protective layer, as described above.

In certain embodiments, the bristles 12 of the hair-setting tool 60 and heating component 105 are both heat-conductive, further improving by the hair-setting properties of the hair-setting tool 60 However, since the bristles 12 might directly contact scalp of a user, the temperature of the heating component 105 may be controlled in a relatively strict manner, or, alternatively, the bristles 12 may be less heat-conductive than the heating component 105.

Figure 7:
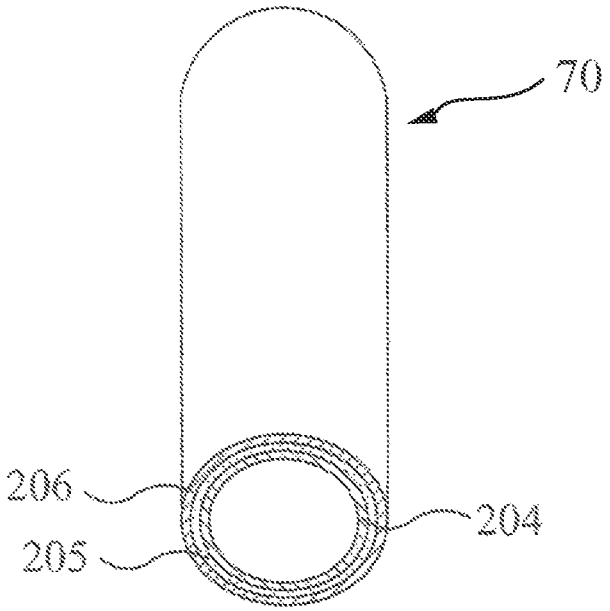
FIGS. 7-9 are schematic diagrams of hair roller hair-setting tools of varying shapes, according to embodiments of the present invention.
Figure 8:
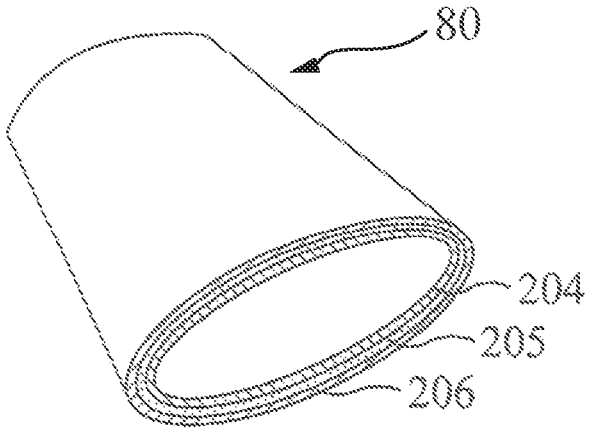
Figure 9:
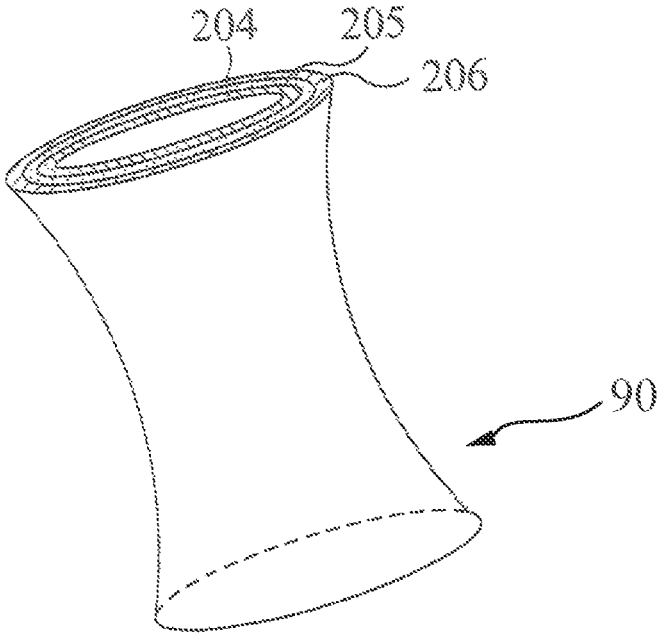

In addition to combs, brushes or similar hair-setting tools, the hair-setting tools according to the present invention also include hair roller hair-setting tools. FIGS. 7-9 illustrate non-limiting embodiments of the hair roller hair-setting tools of the present invention in which each hair roller hair-setting tool 70, 80, and 90, has a different shape. In any of the hair roller hair-setting tools of the present invention, the heating component 205, may be attached onto all or a portion of the outer surface 204 of the hair roller body, and the heating component 205 may be partially or entirely covered by a protective layer 206. Alternatively, not shown, the heating component can be used as the inner portion of the hair roller heat-setting tool to retain heat. As a non-limiting example, the inner portion of the hair roller may be a rod foil core, which may be much lighter than the internal structure used for traditional rollers, may save money compared to other core structures for traditional rollers, and may control and retain heat better than traditional rollers. In other embodiments not shown, the heating component can be located on the clips used to hold the hair rollers in place.

Figure 10A:
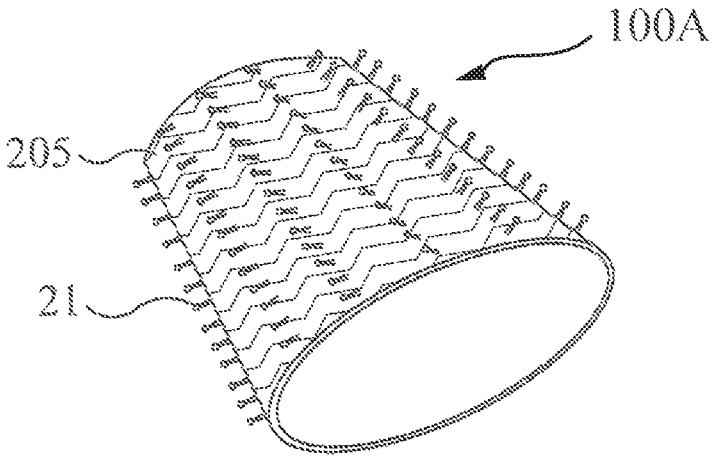
FIG. 10A is a schematic diagram of a hair roller hair-setting tool that includes bristles or posts according to an embodiment of the present invention.
Figure 10B:
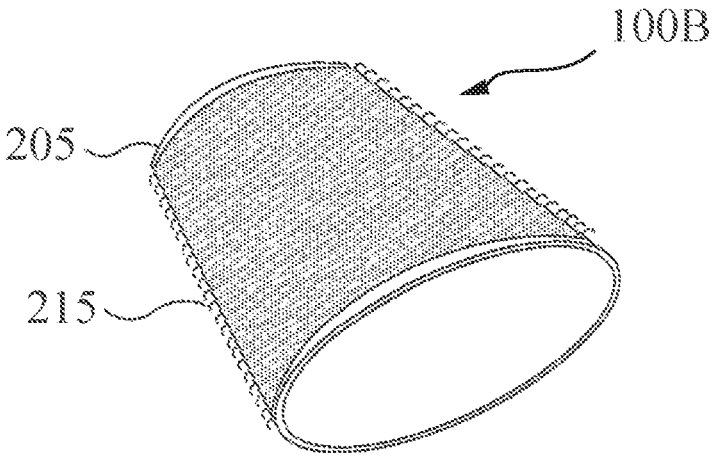
FIG. 10B is a schematic diagram of a hair roller hair-setting tool that includes a carpeting structure according to an embodiment of the present invention.

Another embodiment of a hair roller hair-setting tool of the present invention is the hair roller hair-setting tool 100A shown in FIG. 10A, where mini-posts or bristles 21 may be formed on or attached to the heating component 205. Not shown, a protective layer may be placed on top of the heating component 205. In a further embodiment, as shown in FIG. 10B, a carpeting structure 215 may be formed by a plurality of mini-posts, hook posts, loop posts, curved posts, or Velcro or Velcro-like loops. In certain embodiments, the heating component 205 (not shown) is disposed in whole or in part under the carpeting structure 215. Alternatively, a protective layer 206 may be disposed over the heating component 205 and under the carpeting structure 215.

The functions and properties of the heating component 205 and the protective layer 206 are similar to the above-described heating component 105 and protective layer 106 respectively, and the disclosures associated with the heating component 105 and protective layer 106 are herein incorporated by reference.

Figure 11:
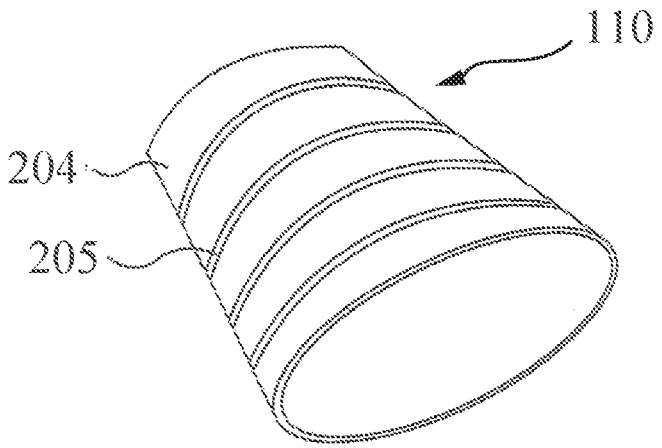
FIG. 11 is a schematic diagram illustrating the placement of the heating component in a hair roller hair-setting tool according to an embodiment of the present invention.

In certain embodiments, the heating components 105 and 205 of the present invention may partially cover the hair-setting tools. FIG. 11 provides an example where the hair roller hair-setting tool contains strips of the heating components 205. In the embodiment set forth in FIG. 11, grooves also may be provided on the surface 204 of the hair roller hair-setting tool for accommodating the heating components 205 so that the heating components 205 are flush or raised with the other surfaces of the hair roller. Grooves may also be used on any surface of the body of any of the hair-setting tools of the present invention, including but not limited to hair curling tools, so as to accommodate the heating components.

Figure 12:
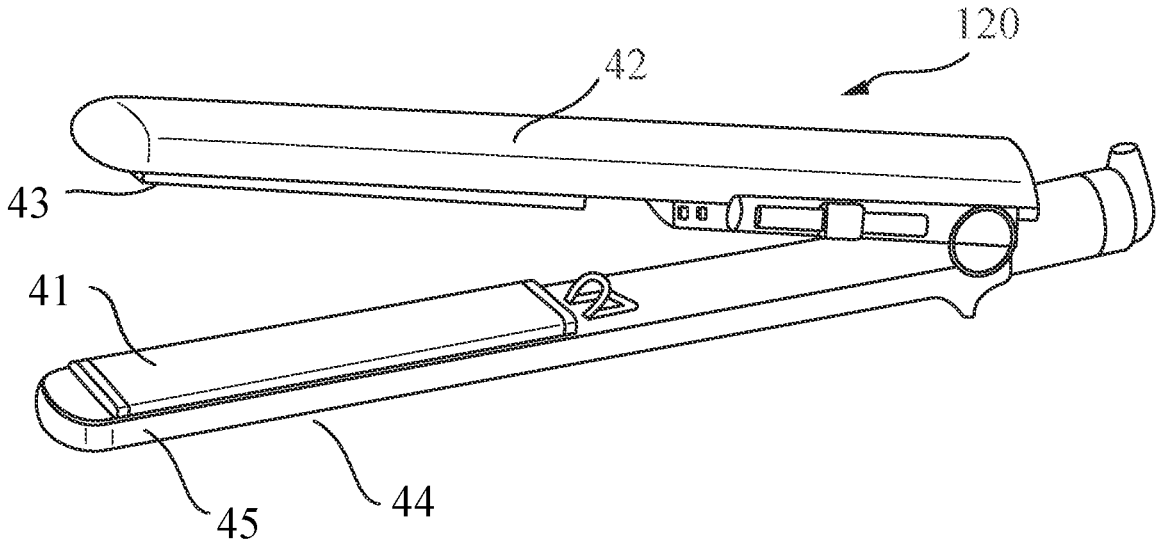
FIG. 12 is a schematic diagram of a hair straightener hair-setting tool according to an embodiment of the present invention.
Figure 13:
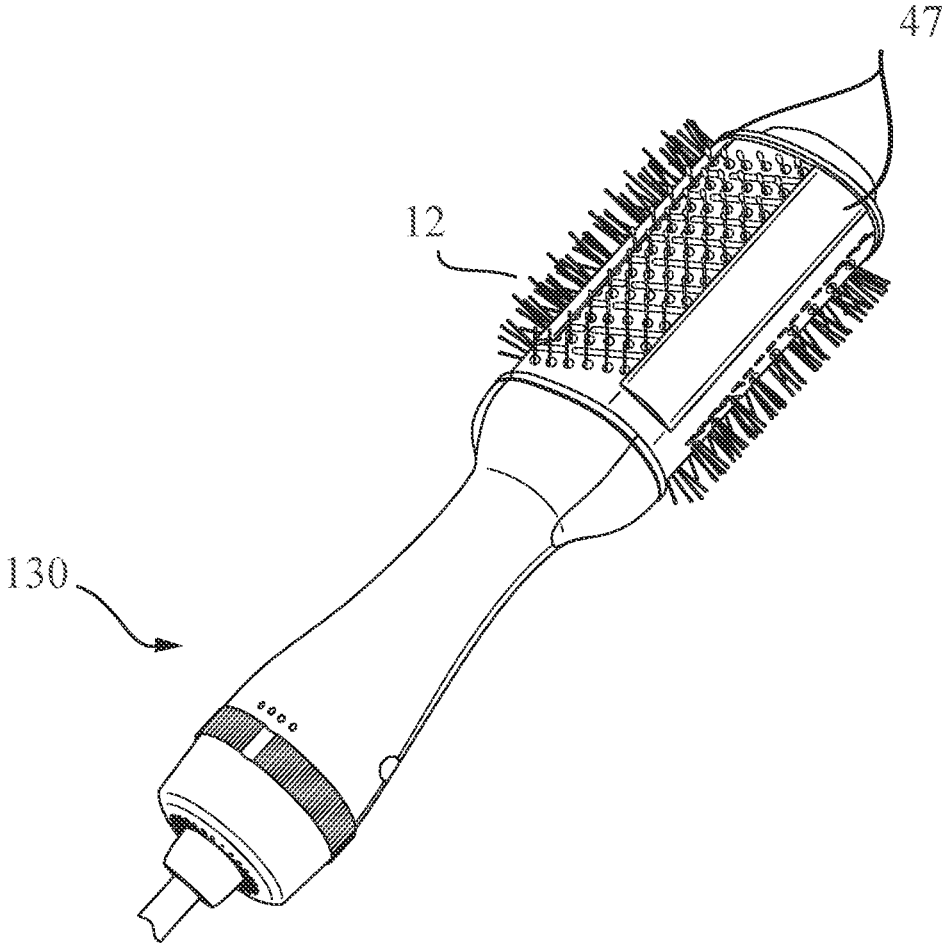
FIG. 13 is a schematic diagram of a hot air brush hair-setting tool according to an embodiment of the present invention.
Figure 14:
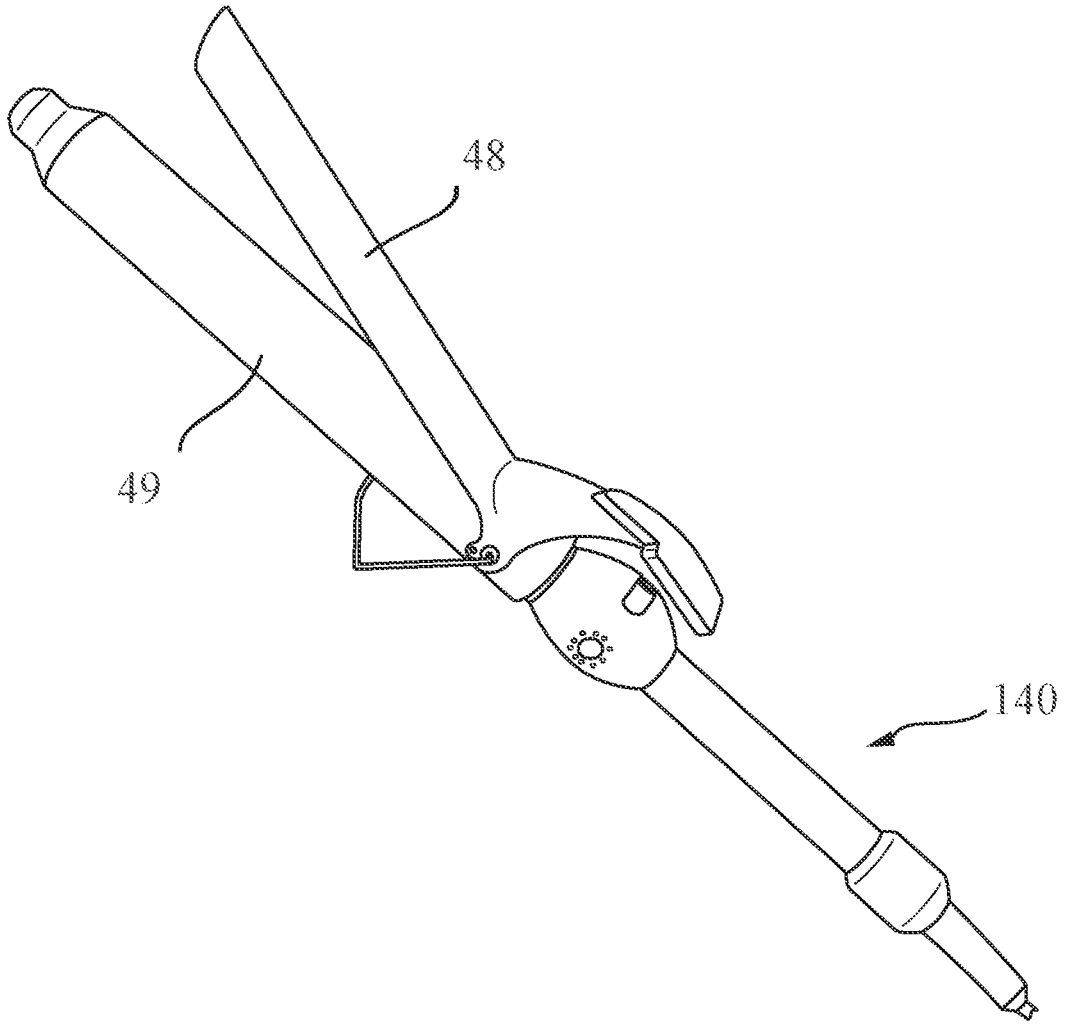
FIG. 14 is a schematic diagram of a curling iron hair-setting tool according to an embodiment of the present invention.

In certain embodiments of the hair-setting tools of the present invention, the hair-setting tool may be a hair straightener, hot air brush, or hair curler hair-setting tool, as depicted in FIGS. 12, 13, and 14 respectively.

In a hair straightener hair-setting tool 120 of the present invention shown in FIG. 12, the heating component may be placed in one, two, three, four or all of the following locations: the pressing plate 41, the pressing plate 42, the outer surface 42, the outer surface 44, and/or the edge 45 of the pressing plate. The heating component (not shown) may be disposed on top of, within, or below these locations or may be integral with such surfaces. In certain embodiments not shown, the edges of the hair straightener hair-setting tool may be curved to allow the user to curl the ends of the hair after straightening it. In such cases, the heating component may be placed on the curved edge of the hair-setting tool to facilitate the curling process. In other embodiments, a protective layer also may be used with the heating component (2) used in the hair straightener hair-setting tool 120, as described previously.

In the hot air brush hair-setting tool 130 of the present invention shown in FIG. 13, the heating component may be placed in strips 47 that alternate with bristles associated with the hot air brush hair-setting tool 130. In other embodiments not shown, the heating component may be disposed beneath the bristles, which may cover all or only portions of the surface of the hot air brush hair-setting tool 130. In certain embodiments, a protective layer may be used in conjunction with the heating component(s).

In the curling iron hair-setting tool 140 of the present invention shown in FIG. 14, the heating component (not shown) may be placed on top of, within, below, or be integral with the curling barrel 49 of the curling iron hair-setting tool 140, and may cover said barrel in whole or in part. In other embodiments, the heating component may be placed on top of, within, below, or be integral with the curling iron clip 48, and may cover said clip in whole or in part. In certain embodiments, the heating component may be placed on top of, within, below, or be integral with both the curling barrel 49 and the curling iron clip 48 of the curling iron hair-setting tool 140. In certain embodiments, a protective layer may be used in conjunction with the heating component(s).

The heating components of the hair-setting tools of the present invention should be capable of being conveniently heated and re-heated to a suitable temperature range and remain hot within at least a suitable operating duration. For example, a suitable temperature range may be from 100 degrees Fahrenheit to about 450 degrees Fahrenheit or higher and a suitable operating duration may be in the range of a few seconds, 15 seconds, 30 seconds, and a few minutes. The heat applied and heating time may vary based on the hair-setting tool and its desired effect. For example, a curling iron may heat faster than a roller, which needs to maintain heat for an extended period of time without electricity. Similarly, if the hair-setting tool is heated in a pouch, or using a battery charger, such a tool may take longer to heat. In certain embodiments, the hair-setting tool will be characterized by wattage rather than temperature, such as, by non-limiting example only, a hot air brush at 1100 watts.

Figure 15A:
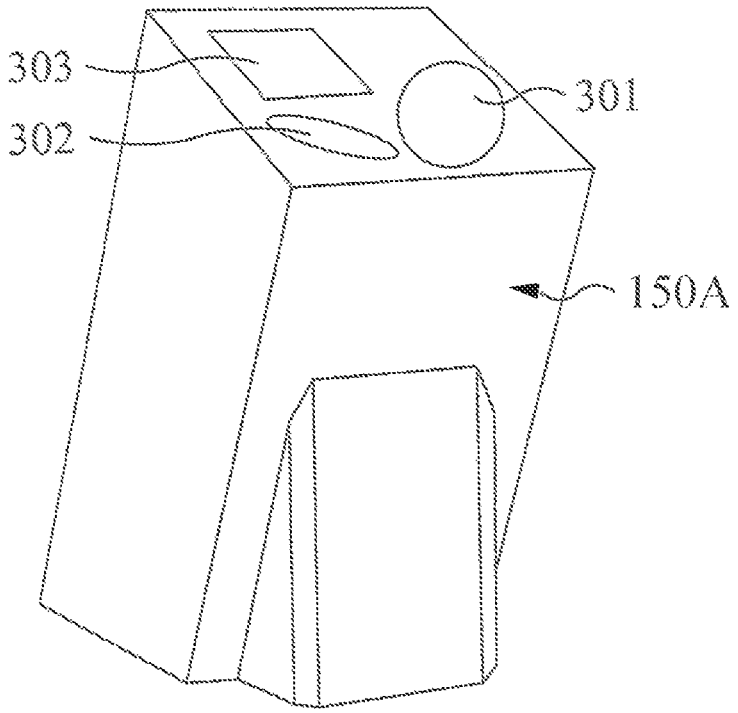
FIG. 15A is a schematic diagram illustrating an example of a heating box for heating a hair-setting tool according to the present invention.
Figure 15B:
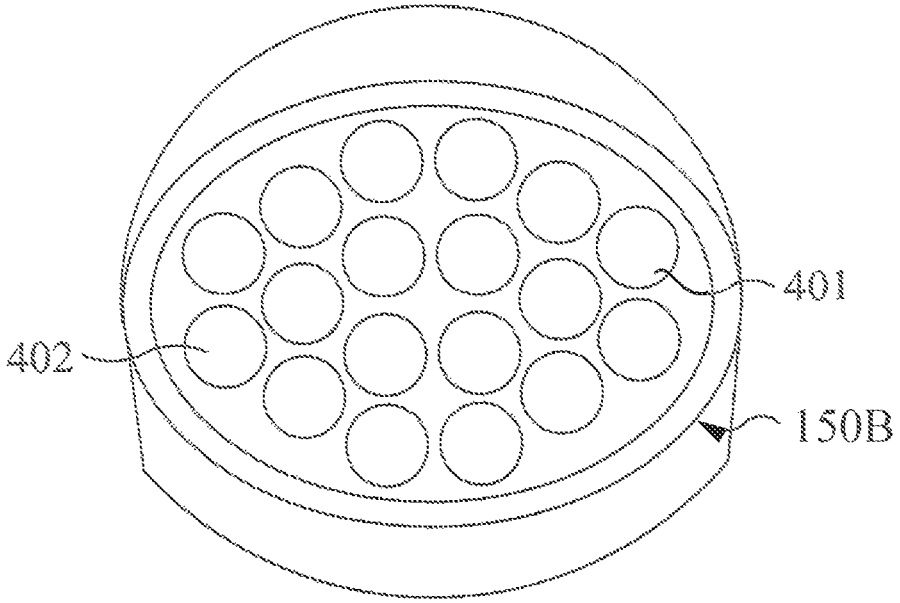
FIG. 15B is a schematic diagram illustrating another example of a heating box for heating a hair-setting tool according to the present invention.

The heating components of the hair-setting tools may be heated or-re-heated by way of a heating source such as a blow dryer, an oven, etc. Alternatively, a heating box as illustrated in FIG. 15A or FIG. 15B can be specially used for heating the heat-enhanced hair-setting tools according to the present invention. For example, a heating box 150A may be used for heating brush hair-setting tools. In this example, the heating box 150A has at least one brush room, e.g. three rooms 301, 302 and 303, in which different sizes and/or shapes of brush hair-setting tools can be heated to raise the temperature of the heating components disposed therein. In another example, a heating box 150B may be used for heating hair roller hair-setting tools. The heating box 150B may have various sizes and/or shapes of rooms 401 and 402 for receiving and heating the hair roller hair-setting tools. In some embodiments (not shown), the heating box is a pouch or sleeve that can be plugged in or heated through the use of electricity, batteries, or the like.

Alternatively, in certain embodiments, the heating component of the hair-setting tools of the present invention may itself be an active heating source, generating heat in any known conventional way, such as chemically, physically, or electrically.

In certain embodiments, the heating component may be in the form of a sheet. In certain embodiments, the heating component may include a plurality of sheets. In other embodiments, the heating component may be in the form of wires, tapes, papers, foils, blocks, balls, dots, micro-dots, strips, and in single layers, multiple layers, or in clusters of such forms.

In certain embodiments, the heating component may be the addition of a heat retentive or heat reflective material, additive, coating, or paint to the hair-setting tool. As a non-limiting example only, the supporting base of a brush hair-setting tool of the current invention may be coated with a paint containing graphene; the coated supporting base will cool down significantly slower and retain heat longer than a conventional brush.

In certain embodiments, the material used for the heating component in the present invention may be easily cut and configured to each chassis style, to allow for easy repair, installation, removal, and replacement.

The heating component of the hair-setting tools of the present invention may consist of any type of heat conducting, retaining, or reflecting material. As one non-limiting example, the heating component of the hair-setting tool of the present invention may be in the form of a metal foil. Metal foils may have several advantages: great heat and flame resistance, high temp and cryogenic properties, compatibility with corrosive chemicals, non-reactive, able to withstand high pressures, having low creep relaxation and no aging, being thermally conductive, lacking hazardous contents, and being RoHS compliant. For example, the metal foil used in any of the above embodiments as the heating component may be a gold reflective foil, which reflects up to 750ºF of radiant heat and has a continuous operating temperature of 500° F. Gold reflective foil will break down at 850° F. of continuous radiant heat. There is up to a 70° F. gradient temperature drop across the 6 mil thick foil during normal operating temperatures.

Other examples of metal materials suitable for the heating component of the hair-setting tool of the present invention include any suitable aluminum products and coatings. Examples of such suitable aluminum products and coatings include, but are not limited to, aluminum foils; aluminum nitride; fireproof aluminum foil; fire resistant aluminum foil; aluminum films coating fiberglass, fabric, cloth, glass, leather, or paper; aluminum foil thermal insulation; waterproof/fireproof single side foil radiant barrier; aluminum foil backed with insulation; double sided foil, both laminated and unlaminated; and woven fabric radiator heat reflection foil. Specific examples of aluminum products and coating that may be suitable for the heating component of the present invention include CarbonX aluminized Fabrics, aluminized Carbon Kelvar®, aluminized CarbonX®, aluminized Kelvar® Blend, aluminized Kelvar® Twill, aluminized Nomex®, aluminized Polybenzamidazole, aluminized Preox®, aluminized Rayon, Lightweight-Herringbone, aluminized Heavy Rayon, aluminized Zetex®, Blackflex, Flame resistant Blue Denim, and Flame Retardant Blue Ducks.

Further examples of metals that may be suitable for the heating component include, but are not limited to, copper, tin, stainless steel, nickel, silver, silver reflective foil, brass, and any alloy combination of metal. Metals that are impregnated with other materials that have heat retentive or heat reflective properties, including but not limited to graphene, are also contemplated.

In certain embodiments, the heating component of the hair-setting tool of the present invention may be a non-metal material that has suitable heat conducting, heat retaining, or heat reflecting properties. Non-limiting examples include glass cloth, golden glass, Vinex, Green Rayon twill, conductive tapes (including Kapton tape), thermal plastics, ceramics, graphene, graphite, graphene paints, and coated papers.

Chart 1 below further includes other materials that may be used for the heating component of the hair-setting tool of the present invention.

The hair-setting tools of the present invention include several components other than the heating component. In certain embodiments, the materials around or near the heating component may be chosen for their resistance to high temperatures. The material suitable to form the hair-setting tools, such as, e.g., the portions around or near the heating component, include, but are not limited to, silicone rubber tubing, including silicone rubber tubing that is heat resistant for powder coating to 500° F.; silicone paint and/or seal dip, including but not limited to silicone end-seal dips; silicone sponges; silicone sponge cord; silicone rubber cord and/or rope; silicone tape; silicone adhesives and/or sealants; silicone rubber extruded gaskets and seal shapes; silicone extended gaskets; silicone end-seal dips; silicone strips, including but not limited to silicone flexible strips; silicone rubber coated fabrics, including fire blankets, welding blankets, and curtain shield fabric and cloth; impregnated silicone; silicone coated fiberglass, rope, and other materials; silicon rubber coated fiberglass; silicone tape; silicone nitride; silicone carbide; and any other silicone or silicone-type products that is high temperature resistant. In addition, the material suitable to form the hair-setting tools, such as, e.g., the portions around or near the heating component, include, but are not limited to products containing PTFE (polytetrafuoroethylene), including but not limited to knitted, twisted square rope with PTFE; hollow gasket rope with sleeve core-clip mount; rope with wire mesh core; wire jacketed seals; rope with graphite; Vermiculite coated rope; silica rope; ceramic rope; stainless steel mesh rope; and products containing fiberglass, such as rubberized fiberglass; fiberglass with PTFE impregnation and self-adhesive, plain and heat-treated fiberglass fabric, fiberglass with wire reinforcement, fiberglass with vermiculite, fiberglass tad pole gasket tape, vinyl coated fiberglass, aluminized fiberglass, and fiberglass high temperature tape with silicone adhesive cloth.

In some embodiments of the hair-setting tool of the present invention, the body of the hair-setting tool is adapted to allow heat to be transferred out of the hair-setting tool. As a non-limiting example only, for hair-setting tools that include bristles, the steam or heat may pass through the holes where bristles penetrate. Alternatively, the supporting base, cushion member, or other surfaces of the hair-setting tool may have vents or holes to transfer steam or heat out of the tool.

Chart 1 below further includes other materials that may be used for the hair-setting tool of the present invention other than the heating component.

The material suitable to form the protective layer described above in various embodiments of the hair-setting tools of the present invention, may be in a form of a continuous layer, porous layer, array of mini-posts, carpeting structure with mini-posts, cushion member, or any other suitable form. In certain embodiments, the materials for the protective layer may be coextensive with the materials described above for the hair-setting tool other than the heating component, and includes the non-limiting examples of materials set forth in Chart 1.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures, as well as to cover the use of materials have substantially the same desired properties set forth in this specification.

CHART 1

| | | |
|---|---|---|
| All Kevlar and Kevlar type products | Novana and Novana type products | Zirconia |
| All Nomex and Nomex type products | Tuff - weld | Silicon nitride |
| All Manocellulos type products | Twardon micro fiber | Cordierite |
| All S glass materials | All Kapton type products | Mullite |
| Insilmax Silica | Vertex and vertex type products | Steatite |
| Alumax | Flame retardant clear vinyl | Calcium oxide |
| Vinyl coated polyester | Heat transfer vinyl HTV | Sialon |
| Heat resistant glass | Nomex meta aramid lacing tape | Macerite HSP |
| All heat reflective materials and fabrics | Silica Textiles products | Photoveel II |
| Stainless steel | Salmon cloth and type products | Photoveel II-S |
| Acrylic fiber with PTFE impregnation braided gasket rope | Zetex and Zetex type products | M soft |
| All products with PTFE | High temp tapes like 3M | BN HC |
| Vermiculite coated products | Teck Fliex type products | BN N-1 |
| Carbon fiber | Flexo Pet (PT) and Flexo Pet type products | NB |
| Ceramic paper, fabric, foils, ropes and other ceramic products | Rust-oleum type coatings and sprays | S BN |
| Graphite - all types | Polyimide foams and films | Universal glass |
| Weld backing tape | Processable polyimides containing APB and reactive end caps | Toughened glass |
| Weldview | Super thermal products and super thermal type products | Tampax |
| High temp rope with mesh coil | Thermal reflective insulation | Pyrex |
| High temp wire jacketed seals | Astro eco radiant barrier insulation | Neoceram |
| All heat reflective materials | High temperature polymers such as synthesized polybenzimidazole (PBI) | Quartz |
| Acrylic fiber with PTFE impregnation braided gasket rope | Masterbond adhesive, sealants, and coatings | Baycol |
| All products with PTFE | Hafnium carbine (HfC) | Sapphire glass |
| Active and activated carbon | Tantalum carbine (TaC) | General purpose furnace material |
| Ba salt rock fiber | Pryo rope products | Fireproof cement |
| All Flexo type products | Silver aluminized carbon fiber | Regular cement |
| High temp Kapton tape by bamboo shed/silicone masking tape | Metallic carbon fiber | Tungsten |
| All high temp tapes | Reflections carbon fiber | Molydenum |
| Stainless steel mesh rope, foil, spray | Mirage carbon fiber | Niobium |
| Spider silk and synthetic spider silk | Top Seiko, LTD products | Heat resistant steels |
| Fire resistant heat reflective film | Alumira | Electrical tapes |
| Fluetape | NASA environmental barrier coating (EBC) products | High temp masking tapes like 3M |
| Zetex and Zetex plus | High performance polyimide prod and reflective end caps | Nextel |
| Insulfex products | Processed polyimides containing APB | Insulflex |
| Super therm products | | Radiant barrier products |
| | | NASA heat resistant carbon fiber |
| | | NASA reflective materials |
| | | High temp polymers and synthesized polybensimodole (PBI) |
| | | Mustuband products |
| | | Advanced ceramics such as: Alumina, Zirconia, silicone nitride, silicone carbide, cordierite, mullite, stealite, Macerite HSP, Photoveel II, Photoveel II-S. |

What is claimed is:

1. A hair-setting tool, comprising:

a body; and a heating component disposed within said body, wherein said heating component conveys heat, steam, or both heat and steam to the hair; and a coating or paint disposed on top of at least a portion of the body, wherein the coating or paint generates heat, retains heat, reflects heat, or any combination thereof, and wherein the coating or paint comprises gold, copper, graphene, or any combination thereof, wherein the hair-setting tool further comprises one or more holes or vents through which heat, steam, or both heat and steam from the heating component dissipates, and wherein the one or more holes or vents extend (i) through the coating or paint and (ii) into at least part of the body.

2. The hair-setting tool of claim 1, wherein the coating comprises one or more sheets of gold or copper foil.

3. The hair-setting tool of claim 1, wherein the coating or paint comprises graphene.

4. The hair-setting tool of claim 1, wherein the coating comprises one or more lengths of gold or copper tape.

5. The hair-setting tool of claim 1, wherein the body of the hair-setting tool further comprises a supporting base and bristles and wherein in the hair-setting tool is selected from the group consisting of a cushion brush hair-setting tool, a detangling brush hair-setting tool, a round brush hair-setting tool, a vent brush hair-setting tool, and a hot air brush hair-setting tool.

6. The hair-setting tool of claim 1, wherein the hair-setting tool is selected from the group consisting of a smooth barrel hair-setting tool, a covered barrel hair-setting tool, one or more hair roller hair-setting tools, a hair straightener hair-setting tool, a hot comb hair-setting tool, and a curling iron hair-setting tool.

7. The hair-setting tool of claim 1, wherein the coating comprises electroplated copper.

8. A hair-setting tool, comprising:

a body; and a heating component disposed at least in part on top of the body of the hair-setting tool; and a protective layer disposed at least in part on top of the body, wherein said heating component conveys heat, steam, or both heat and steam to the hair;

wherein at least a portion of the body of the hair-setting tool further comprises bristles;

wherein the protective layer comprises a carpeting structure, and wherein the carpeting structure comprises a plurality of mini-posts, hook posts, loop posts, or curved posts;

wherein one or more holes or vents extend (i) through the carpeting structure and the protective layer, and (ii) into at least part of the body of the hair-setting tool; and wherein the hair-setting tool is selected from the group consisting of a cushion brush hair-setting tool, a detangling brush hair-setting tool, a round brush hair-setting tool, a vent brush hair-setting tool, and a hot air brush hair-setting tool.

9. The hair-setting tool of claim 8, wherein the heating component comprises one or more sheets of metal foil.

10. The hair-setting tool of claim 8, wherein the heating component comprises one or more lengths of conductive tape.

11. The hair-setting tool of claim 8, wherein the heating component is disposed on the surface opposite or adjacent to the bristles of the hair-setting tool.

12. The hair-setting tool of claim 8, wherein the heating component is a coating or paint covering all or a portion of the body, and wherein the coating or paint generates heat, retains heat, reflects heat, or a combination thereof.

13. The hair-setting tool of claim 12, wherein the coating or paint comprises graphene.

14. The hair-setting tool of claim 12, wherein the coating comprises gold or copper foil.

15. The hair-setting tool of claim 12, wherein the coating comprises one or more lengths of gold or copper tape.

16. The hair-setting tool of claim 12, wherein the coating comprises electroplated copper.

17. A hair-setting tool, comprising:

a body;

a heating component disposed within the body; and a protective layer disposed on top of at least a portion of the body, wherein said heating component conveys heat, steam, or both heat and steam to the hair;

wherein at least a portion of the body of the hair-setting tool further comprises bristles;

wherein at least a portion of the protective layer comprises a carpeting structure, and wherein the carpeting structure comprises a plurality of mini-posts, hook posts, loop posts, curved posts, loops, or a combination thereof;

wherein one or more holes or vents extend (i) through at least the carpeting structure and the protective layer, and (ii) into at least part of the body of the hair-setting tool; and wherein the heat, the steam, or both the heat and the steam from the heating component dissipates to the hair through the one or more holes or vents.

18. The hair-setting tool of claim 17 above, wherein at least one additional heating component is disposed on top of at least a portion of the body and conveys heat, steam, or both heat and steam to the hair.

19. The hair-setting tool of claim 18, wherein the at least one additional heating component comprises one or more sheets of metal foil.

20. The hair-setting tool of claim 18, wherein the at least one additional heating component comprises one or more lengths of conductive tape.

21. The hair-setting tool of claim 18, wherein the hair-setting tool further comprises a cushion disposed (i) on top of at least a portion of the body of the hair-setting tool and (i) below at least a portion of the protective layer of the hair-setting tool, and wherein the at least one or more of the holes or vents further extends through the cushion.

22. The hair-setting tool of claim 18, wherein the body of the hair-setting tool is cylindrical.

23. The hair-setting tool of claim 18, wherein at least a portion of the body of the hair-setting tool further comprises a plurality of teeth.

24. The hair-setting tool of claim 18, wherein at least one of the holes or vents extends completely through the body of the hair-setting tool.

25. The hair-setting tool of claim 18, wherein the hair-setting tool is a hot air brush.

26. The hair-setting tool of claim 18, wherein the at least one additional heating component is a coating or paint disposed on top of at least a portion of the body;

wherein the coating or paint generates heat, retains heat, reflects heat, or any combination thereof; and wherein the coating or paint comprises gold, copper, graphene, or any combination thereof.

27. The hair-setting tool of claim 17, wherein the hair-setting tool further comprises a cushion disposed (i) on top of at least a portion of the body of the hair-setting tool and (ii) below at least a portion of the protective layer of the hair-setting tool, and wherein the at least one or more of the holes or vents further extends through the cushion.

28. The hair-setting tool of claim 17, wherein the body of the hair-setting tool is cylindrical.

29. The hair-setting tool of claim 17, wherein at least a portion of the body of the hair-setting tool further comprises a plurality of teeth.

30. The hair-setting tool of claim 17, wherein at least one of the holes or vents extends completely through the body of the hair-setting tool.

31. The hair-setting tool of claim 17, wherein the hair-setting tool is a hot air brush.

32. The hair-setting tool of claim 17, wherein the hair-setting tool further comprises a coating or paint disposed on top of at least a portion of the body;

wherein the coating or paint generates heat, retains heat, reflects heat, or any combination thereof; and wherein the coating or paint comprises gold, copper, graphene, or any combination thereof.

* * * * *